US006447430B1

(12) United States Patent
Webb et al.

(10) Patent No.: US 6,447,430 B1
(45) Date of Patent: Sep. 10, 2002

(54) EXERCISE MACHINE

(75) Inventors: Gregory M. Webb, Independence, VA (US); Brian R. Cook, Vancouver, WA (US)

(73) Assignee: Nautilus, Inc., Vancouver, WA (US)

( * ) Notice: Subject to any disclaimer, the term of this patent is extended or adjusted under 35 U.S.C. 154(b) by 0 days.

(21) Appl. No.: 09/502,339

(22) Filed: Feb. 10, 2000

(51) Int. Cl.[7] ..... A63B 21/06
(52) U.S. Cl. ..... 482/98; 482/93; 482/94
(58) Field of Search ..... 482/93, 94, 97–103, 482/133, 908, 148, 135–138

(56) References Cited

U.S. PATENT DOCUMENTS 4,603,855 A * 8/1986 Sebelle
4,634,127 A * 1/1987 Rockwell
4,721,303 A * 1/1988 Fitzpatrick
4,898,381 A 2/1990 Gordon
5,211,614 A * 5/1993 Henes
5,725,459 A 3/1998 Rexach
5,921,897 A * 7/1999 Stevens

* cited by examiner

*Primary Examiner*—Jerome W. Donnelly
(74) *Attorney, Agent, or Firm*—Flehr Hohbach Test Albritton & Herbert LLP

(57) ABSTRACT

Exercise machine having a frame with a pair of upstanding sections disposed substantially at right angles to each other, a weight stack mounted on each of the frame sections, a cable coupled to each of the weight stacks for transferring a pull on the cable to the weights in the stack, a pulley block through which the cable is pulled, a leg connected to each of the frame sections for movement between a supporting position and a storage position, interlock means engagable between the legs and respective ones of the weight stacks for preventing the weights from being raised when the legs are in the storage position, a bench which is removably connected to the frame and can be folded up between the two frame sections for storage, a carriage mounted on each of the frame sections and adapted to be positioned at different heights, and means mounting one of the pulley blocks on each of the carriages such that each of the pulley blocks is free to pivot about two axes of rotation so that the pulley block can follow the cable and remain aligned with the cable regardless of the direction in which the cable is pulled.

29 Claims, 8 Drawing Sheets

EXERCISE MACHINE

This invention pertains generally to health and fitness equipment and, more particularly, to an exercise machine which can be used in performing a number of different exercises.

Heretofore, there have been some attempts to provide exercise machines for use in performing weight lifting exercises without the problems associated with free weights. Such machines have utilized confined weight stacks, springs and other resistance elements, and have employed various means to place operating elements such as handles and bars in the proper position for different exercises.

U.S. Pat. No. 4,603,855, for example, shows a machine having two weight stacks with cables trained about pulleys on telescoping arms which are mounted on vertically adjustable carriages and can be swung to different angles for different exercises.

U.S. Pat. No. 4,898,381 shows a machine in which two weight stacks are mounted side-by-side on a central main frame. The pulleys from which the cables are drawn are mounted on vertically adjustable carriages which are mounted on side frames which are pivotally connected to the main frame. By adjusting the angles of the frames and the height of the carriages, the cables are positioned for different exercises.

U.S. Pat. No. 5,725,459 shows a machine in which two weight stacks can be moved to different positions along opposite sides of an L-shaped frame for storage and use. A barbell extends diagonally between the stacks and is connected to cables which are coupled to the stacks and trained about pulleys mounted on carriages which can be adjusted to different heights. This machine also has a removable bench which can be folded up between the two sides of the frame for storage.

It is in general an object of the invention to provide a new and improved exercise machine for use in performing a number of different exercises.

Another object of the invention is to provide an exercise machine of the above character which overcomes the limitations and disadvantages of the prior art.

These and other objects are achieved in accordance with the invention by providing an exercise machine having an upstanding frame, a pair of cables adapted to be pulled by an exerciser, means carried by the frame for independently resisting the pull on each of the cables, a pair of carriages mounted on the frame and adapted to be adjusted to different heights, and pulley blocks from which the cables are pulled mounted on the carriages, each of the pulley blocks being free to pivot about two axes of rotation so that the pulley blocks can follow the cables and remain aligned with the cables regardless of the directions in which the cables are pulled.

The machine also has legs connected to the frame for movement between supporting and storage positions, interlock means engagable between the legs and the weight stacks for preventing the weights from being raised when the legs are in the storage position, and a fully adjustable bench which is removably connected to the frame and can be folded up between the two frame sections for storage FIG. 1 is an isometric view of one embodiment of an exercise machine incorporating the invention.

Figure 1:
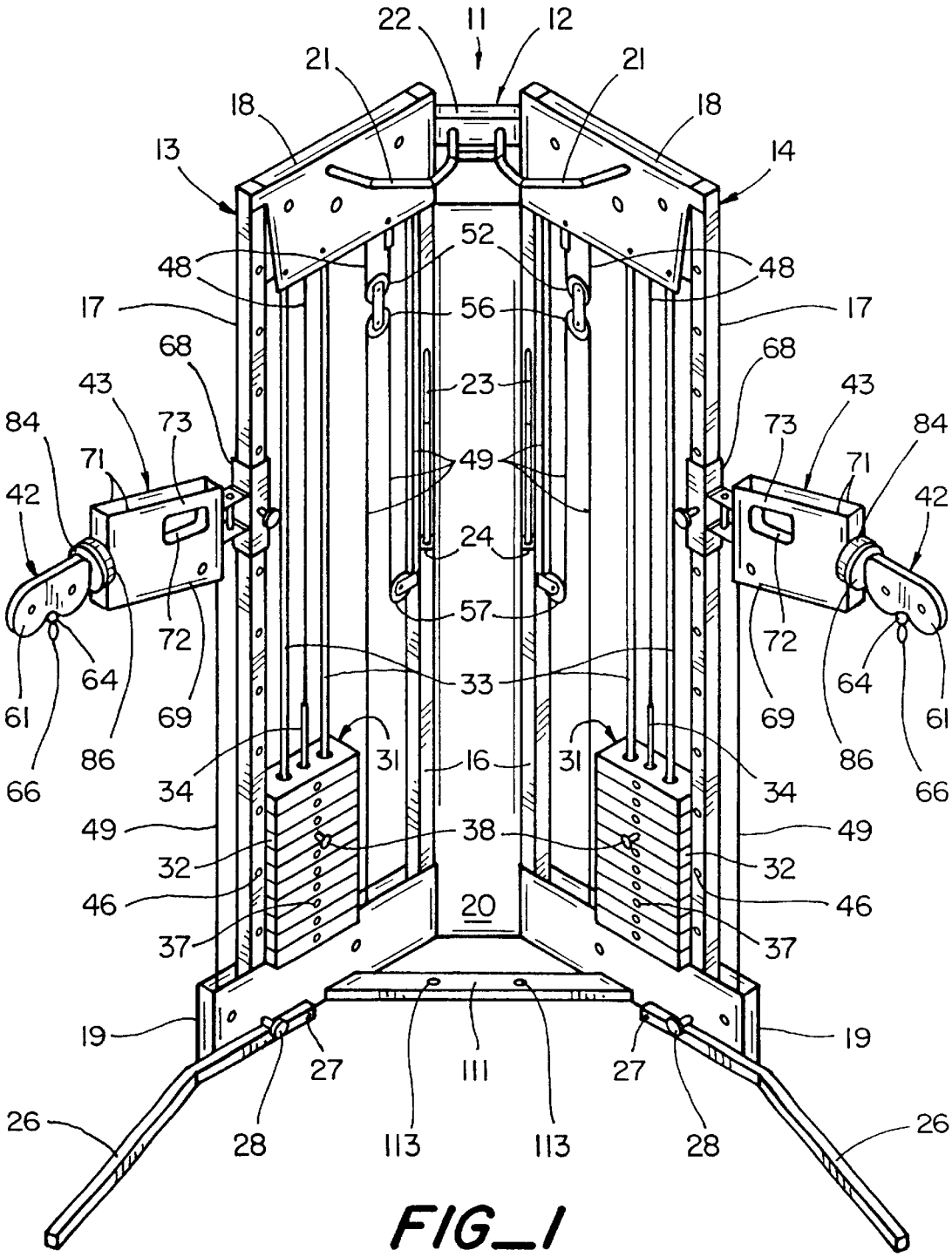
Figure 2:
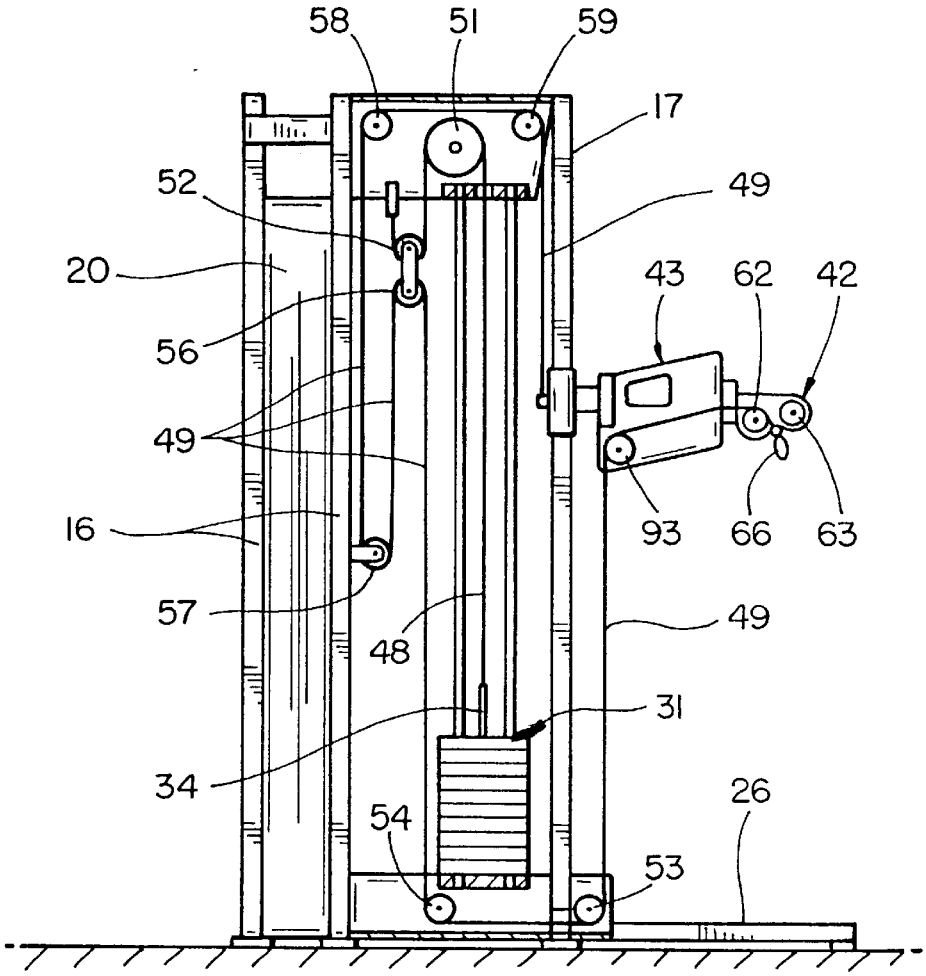
FIG. 2 is a side elevational view, partly broken away, of a portion of the exercise machine in the embodiment of FIG. 1, showing the cable and pulley system associated with one of the weight stacks.
Figure 3:
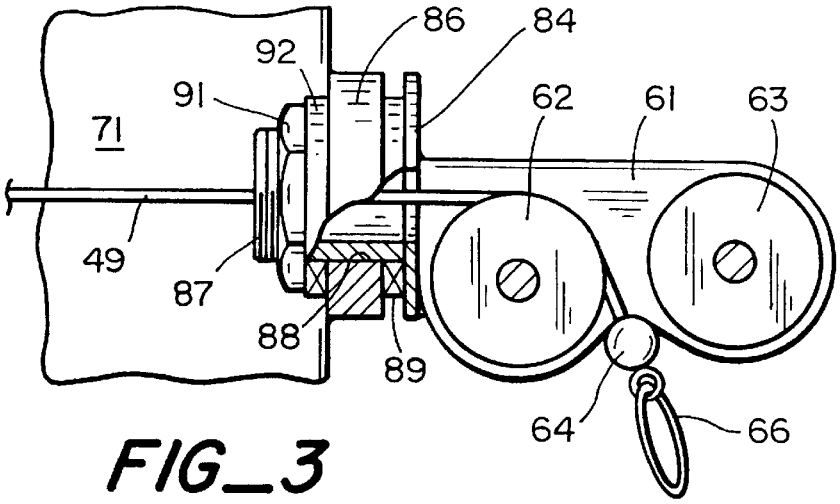
FIG. 3 is a fragmentary side elevational view, partly broken away, of one of the pulley blocks and carriages in the embodiment of FIG. 1.
Figure 4:
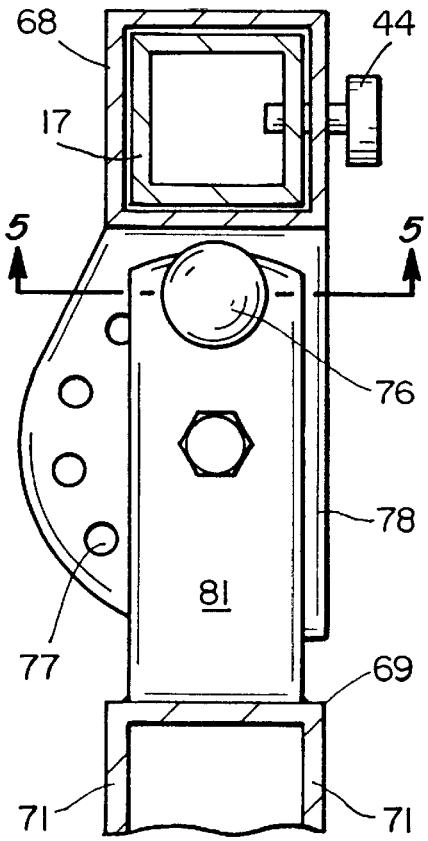
FIG. 4 is a fragmentary horizontal sectional view of one of the carriages in the embodiment of FIG. 1.
Figure 5:
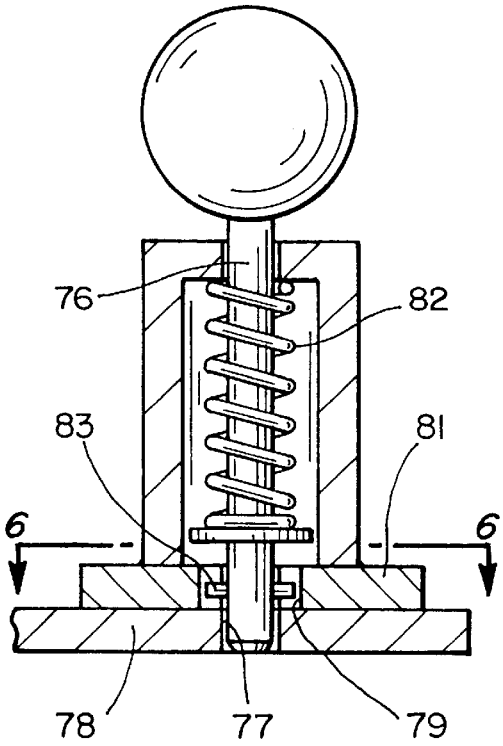
FIG. 5 is an enlarged cross-sectional view taken along line 5—5 in FIG. 4.

As illustrated in the drawings, the exercise machine has an upstanding frame 11 with a central section 12 and a pair of side sections 13, 14. The side sections extend from the central section at an angle of about 135 degrees and are disposed substantially at right angles to each other. The machine is thus adapted to fit in a corner both for storage and for use.

Frame sections 13, 14 are mirror images of each other, and each has an inner frame member or post 16, an outer frame member or post 17, a top rail 18, and a bottom rail 19.

In the central section of the frame, a panel 20 extends between the inner posts 16 of the two side sections, and chinning bars 21 extend outwardly from a crossbar 22 which is rigidly affixed to the upper portions of posts 16. A pair of dip bars 23 are pivotally mounted to brackets 24 which are affixed to posts 16 about midway up the posts. These bars can be swung between a vertical position for storage and a horizontal position for use in performing dips.

A pair of stabilizing legs 26 extend from the side frames to give the machine a larger, more stable base. These legs are pivotally connected to the lower rails of the frames by bolts 27 and are secured in their horizontal position for use by pins 28. When the pins are removed, the legs can be swung to a vertical position for storage.

A weight stack 31 is mounted on each of the side frames. Each of the weight stacks has a plurality of weight plates 32 which are mounted on guide rails 33 and rest on the lower rail of the frame. An operating rod 34 extends through the stack, and the rod and the plates have aligned openings 36, 37 through which a pin 38 can be inserted to connect the plates to the rod. When a given plate is connected to the rod, that plate and any plates above it will be lifted with the rod.

Cables are coupled to the weight stacks and adapted to be pulled upon by a person using the machine, with the amount of resistance determined by the number of plates which are being lifted. The free ends of the cables are withdrawn from pulley blocks 42 mounted on carriages 43 which are mounted on the outer frame members or posts 17 for movement between different vertical positions or heights. The carriages can be locked at the different heights by pins 44 which engage openings 46 in the posts.

The arrangement of the cables is such that a constant tension is maintained in them and the free ends of the unpulled cables remain adjacent to the pulley blocks regardless of the position of the carriages. For this purpose, two cables 48, 49 are employed for each of the weight stacks. Cable 48 is affixed at one end to operating rod 34, from which it extends in an upward direction to a pulley 51 mounted in the top rail of the frame section. From that pulley, it extends down around a floating pulley 52, then back up to the top rail where it is anchored.

From the pulley block, cable 49 extends in a downward direction, around pulleys 53, 54 in the lower rail of the frame section. It then extends upwardly and around a pulley 56 which is linked to floating pulley 52, then back down and around a pulley 57 which is mounted in a fixed position on upright 16. It then extends up and around pulleys 58, 59 in the upper rail, and back down to the carriage where it is anchored. When the position of the carriage is changed, cable 49 simply shifts around on its pulleys, with no change in the effective length of the cable. When the free end of cable 49 is pulled, pulley 56 is drawn in a downward direction, which also draws pulley 52 down, raising the end of cable 48 which is connected to the weights.

Pulley block 42 has a pair of side plates 61, with a pair of pulleys 62, 63 mounded side-by-side between the plates. The pulley block is mounted to the carriage at one end of the side plates, with the cable entering the block through that end, being trained about pulley 62 through an arc length of about 90 degrees, and exiting from the block between the pulleys. A keeper 64 affixed to the free end of the cable prevents the free end from being drawn back into the pulley block. A snap ring 66 is connected to the free end for attachment to handles and the like.

Having the cable enter the pulley block at the end and exit from the side between the pulleys, with the cable being trained about one of the pulleys, has been found to be very advantageous from the standpoint of keeping the cable engaged with the pulley. If the cable simply entered on one side of the block and exited on the other without being trained about a pulley, it would tend to separate from the pulleys and rub against the side plates, rather than staying in the groove, when it is pulled.

The pulley blocks are mounted on the carriages in such manner that they are free to rotate about two different axes of rotation. This enables the pulleys to follow the cables regardless of the direction in which they are pulled, which provides much smoother operation than would be possible if the pulley blocks were fixed.

Each of the carriages includes a collar 68 which is slidably mounted on post 17 and a body 69 which is pivotally connected to the collar for movement about a vertically extending axis. The collar and post are square in cross-section, with the pin 44 which holds the carriage in position on the post being carried by the collar. The body comprises a pair of side plates 71 with openings 72 forming a hand grip 73 which can be grasped by the exerciser for use in adjusting the position of the carriage.

Figure 6:
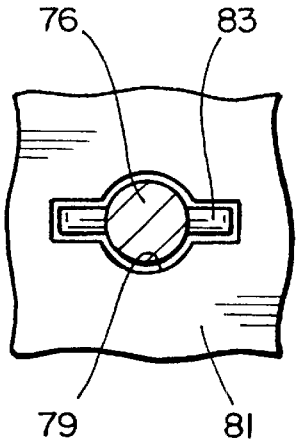
FIG. 6 is an enlarged cross-sectional view taken along line 6—6 in FIG. 5.
Figure 7:
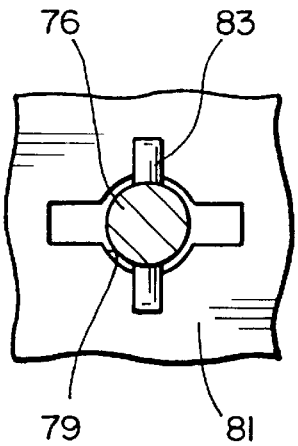
FIG. 7 is a view similar to FIG. 6, showing the lock in its retracted position.
Figure 8:
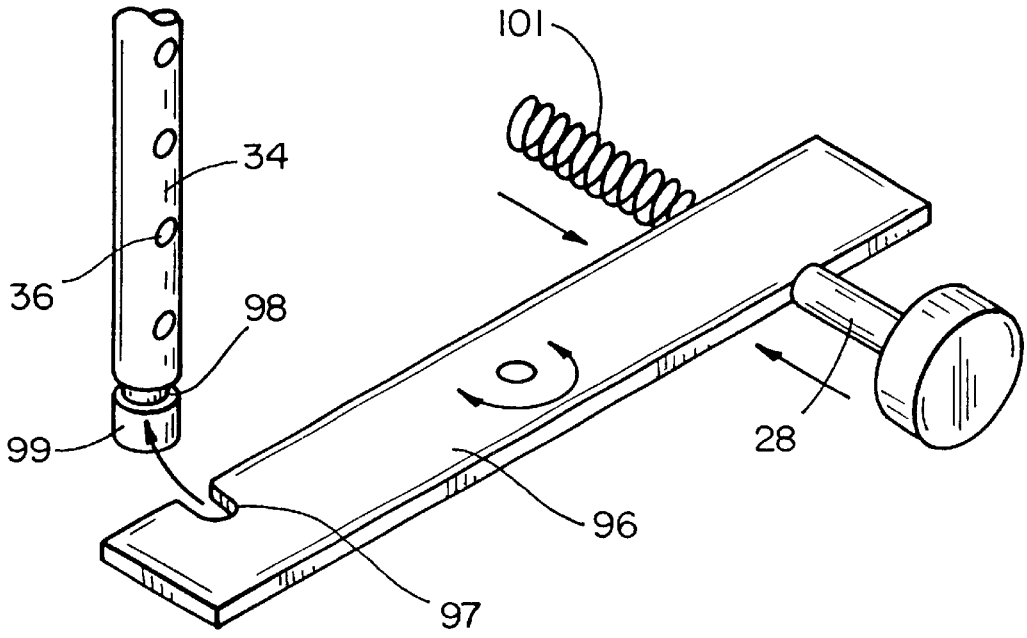
FIG. 8 is an isometric view of an interlock in the embodiment of FIG. 1 for preventing the weights in the stacks from being lifted unless the stabilizing legs are locked in their supporting positions.
Figure 9:
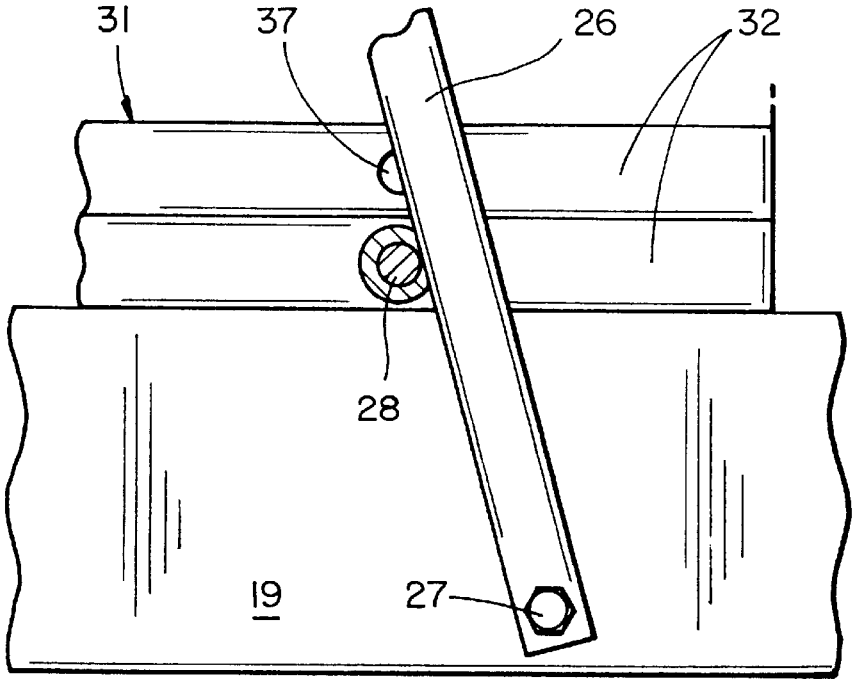
FIG. 9 is a fragmentary elevational view of the embodiment of FIG. 1, showing one of the stabilizing legs in its raised position.

Means is provided for selectively locking the carriage in different rotational positions, if desired. This means includes a pin 76 which is carried by the body of the carriage and can be selectively engaged with openings 77 spaced along a circular path in a sector-shaped plate 78 affixed to the collar. The pin passes through a slotted opening 79 in a flange 81 affixed to the body of the carriage, and is urged toward the sector-shaped plate by a coil spring 82. A cross-pin 83 passes through the slotted opening only when the pin is turned so that the cross-pin is aligned with the slots, as illustrated in FIG. 6. When the pin is turned so that the cross-pin is crosswise to the slots, the cross-pin abuts against the upper surface of flange 81, and the pin cannot engage the openings in plate 78.

Thus, when free rotation of the carriage is desired, pin 76 is retracted and turned so that the cross-pin is crosswise to the slots in opening 79, with pin 76 disengaged from plate 78. To lock the carriage in a desired position, pin 76 is turned to bring the cross-pin into alignment with the slots, then inserted into the desired opening in plate 78.

The pulley block is mounted on the carriage for rotation about a generally horizontal axis. In this regard, a circular flange 84 is affixed to the inner end of the pulley block, and a circular base plate 86 is affixed to the outer end of the carriage body. A short, hollow shaft 87 extends from flange 84 through an opening 88 in base plate 86, with a bearing 89 between the base plate and the flange. The end of the shaft is threaded, and a nut 91 is mounted on it, with another bearing 92 between the nut and the base plate. The nut is locked to the shaft by set screws (not shown). Cable 49 passes through the hollow shaft and is trained about a pulley 93 in the body of the carriage which is aligned with pulley 53 in the bottom rail of the frame.

Means is provided for preventing the weights in the stacks from being raised when the stabilizing legs 26 are not locked in the supporting position. This means includes a latch bar 96 which is pivotally mounted in the lower rail of the side frame, with a notch 97 for engagement with the operating rod 34 to prevent the rod from being raised. A corresponding notch 98 is formed in the near the lower end of the operating rod, with a knob 99 beneath the notch. When the latch is engaged, the notched portion of the rod is received in the notch in the latch bar, and the rod is prevented from moving. The latch is urged into engagement with the rod by a spring 101, and it is moved out of engagement by the pin 28 which locks the leg in its horizontal or supporting position. The pin does not move the latch bar far enough to release the rod until it is fully inserted and the leg is securely locked.

When the legs are in the storage position, lock pins 28 are inserted into the openings 37 in the lowermost plates in the stacks and the corresponding openings in the rods. This serves to hold the legs in the raised position, and it also provides additional means for locking the weights down when the legs are raised.

With the operating rods of the weight stacks locked down, the cables are also locked, and the free ends of the cables cannot be withdrawn from pulley blocks 42.

A bench 103 is removably attached to the frame and adapted to be folded up into the corner for storage. The bench has an inclined beam 104, with a mounting foot 106 at its inner end and a supporting leg 107 at its outer end. A backrest 108 and a seat 109 are mounted on the beam for adjustment to different positions.

Mounting foot 106 rests on a cross member 111 which extends diagonally between the two side sections 12, 13 of the frame. It is retained in place on the cross member by a pins 112 which extend downwardly from the under side of the foot and are received in sockets 113 in the cross member.

The lower or inner end of beam 104 is pivotally mounted on foot 106 by means of a pin 119 which extends between a pair of upstanding flanges 121, 122 on the foot. A lock pin 123 extends through the beam and engages openings 124 in flange 122 to hold the bench in its two positions.

Figure 10:
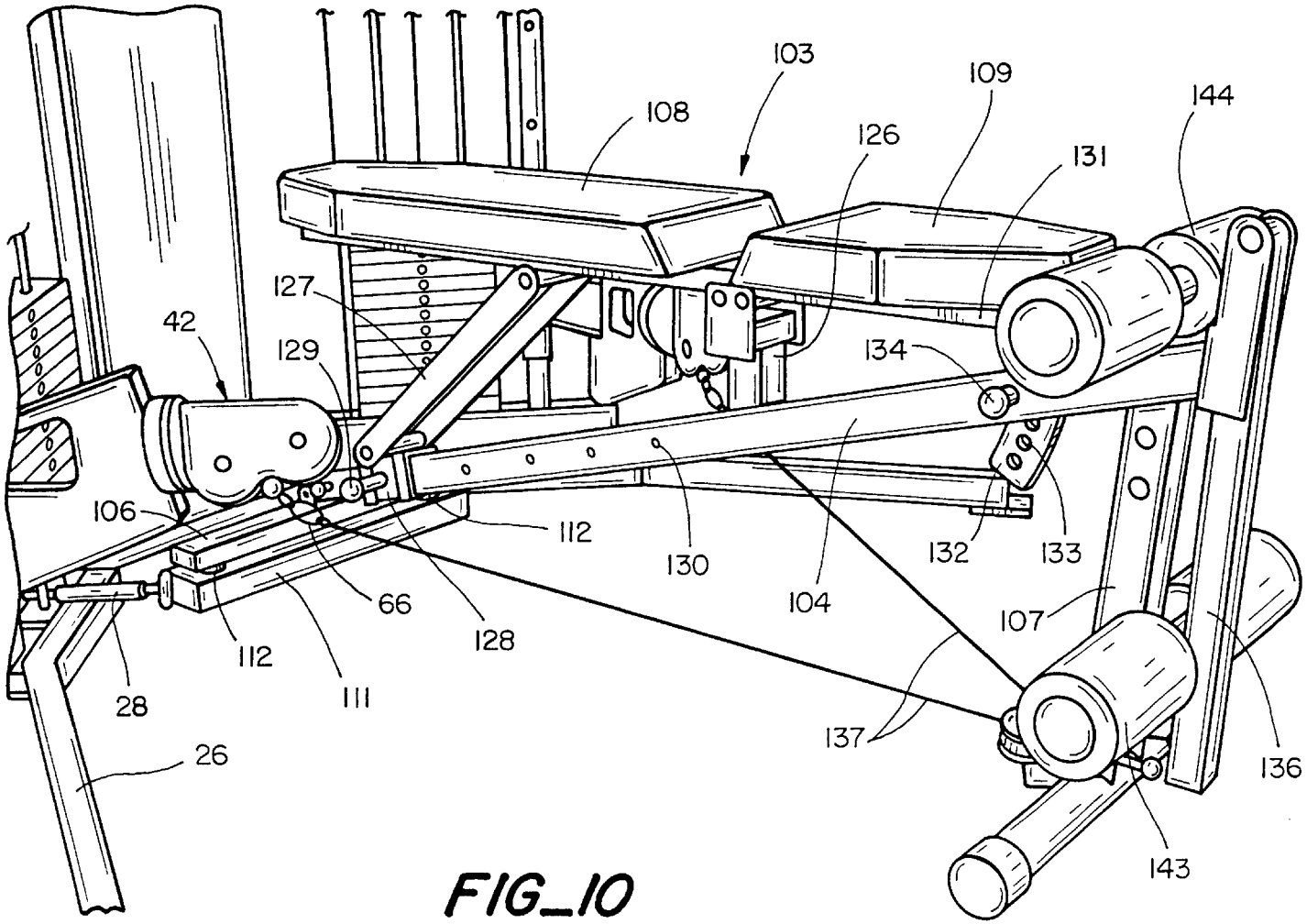
FIGS. 10–12 are isometric views showing a bench attached to the embodiment of FIG. 1.
Figure 11:
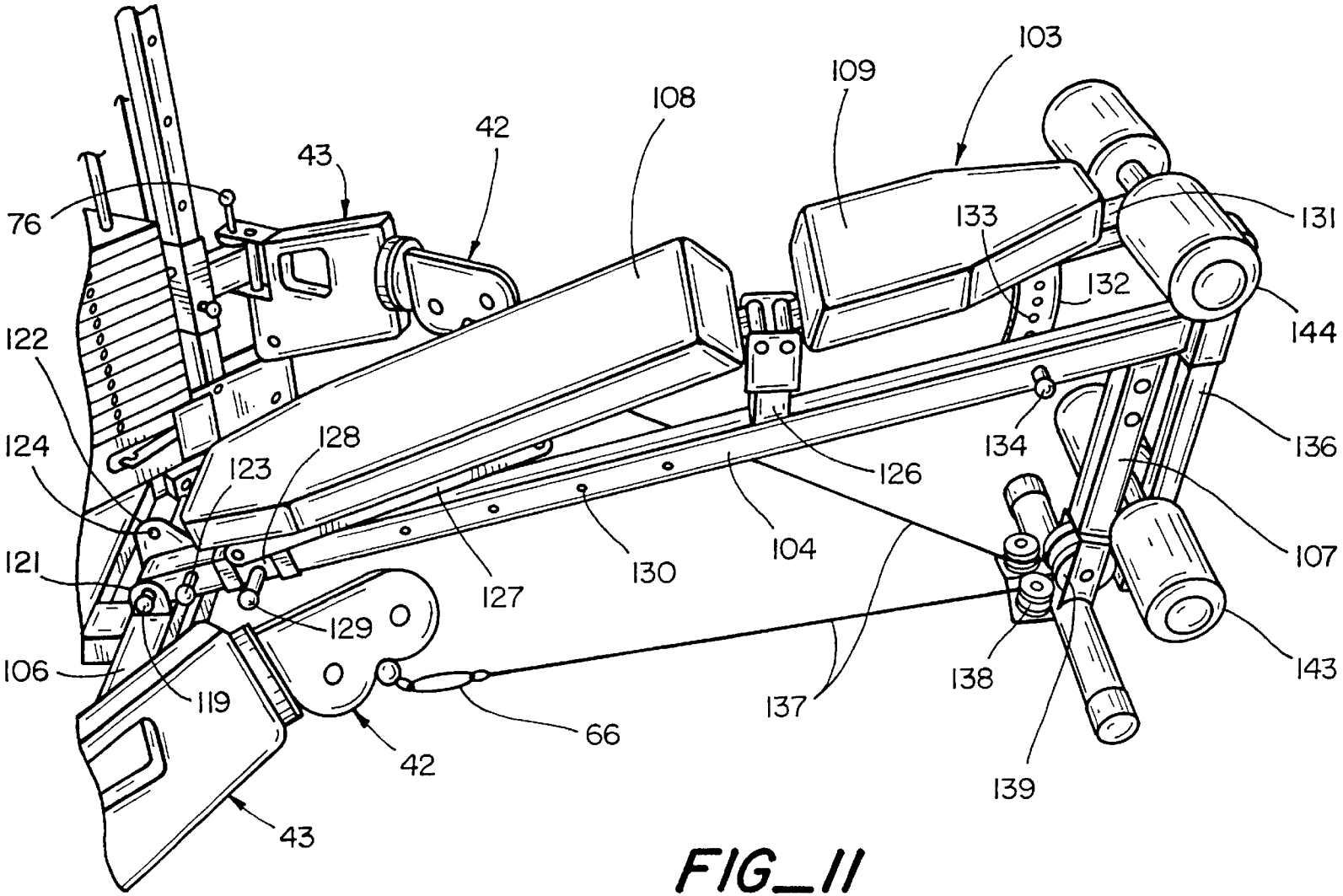
Figure 12:
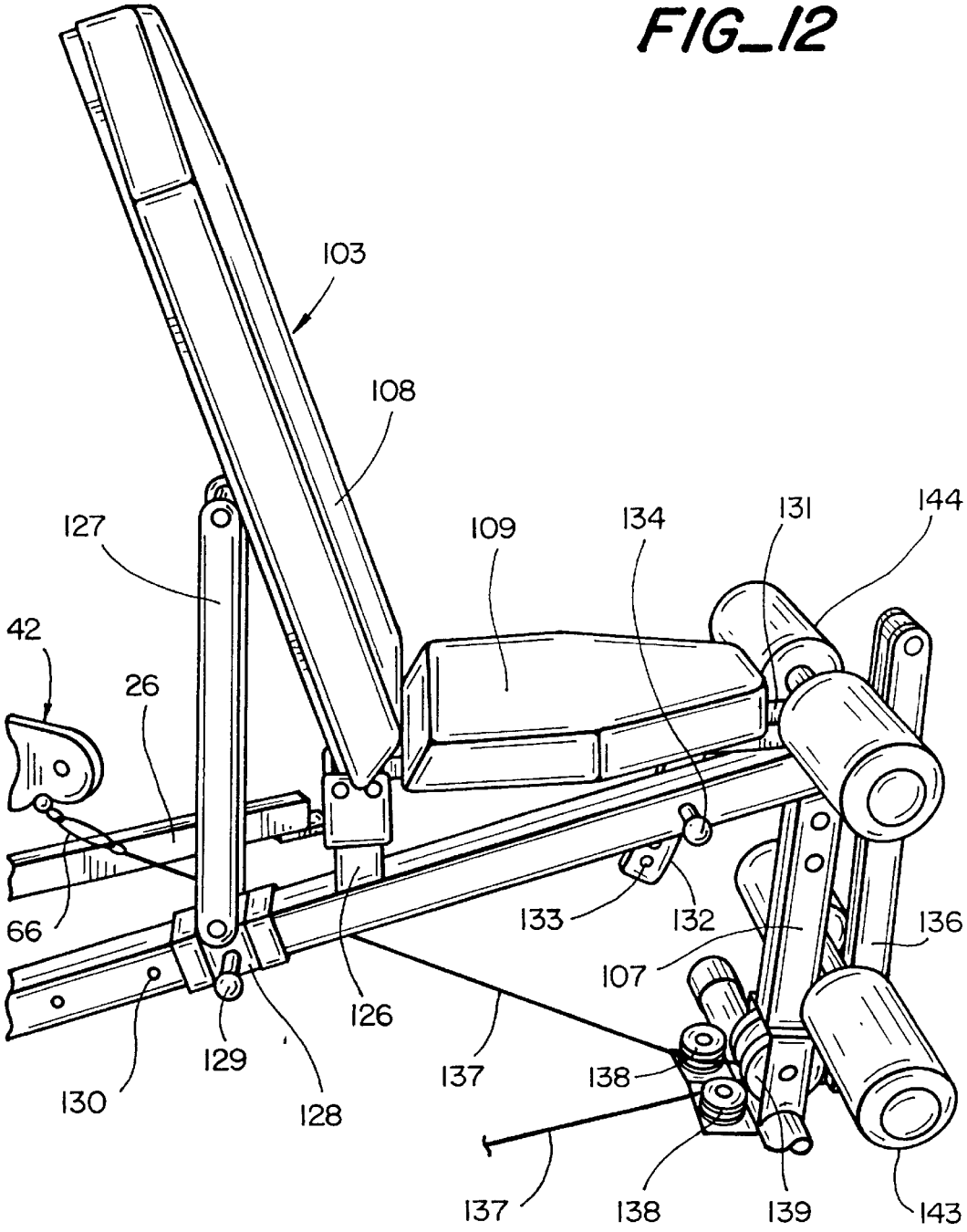

The adjacent edges of backrest 108 and seat 109 are pivotally connected to a short post 126 which extends in an upward direction from beam 104. The backrest is also supported by an adjustable brace 127, one end of which is pivotally connected to the backrest. The other end of the brace is connected to a collar 128 which slides on the beam and can be locked in different positions corresponding to different angles of inclination by a pin 129 which is received in openings 130 in the beam. In the embodiment illustrated, the backrest can be adjusted to a horizontal position, as shown in FIG. 10, a declined position, as shown in FIG. 11, and a plurality of inclined positions, one of which is shown in FIG. 12.

The seat is mounted on an arm 131, the inner end of which is pivotally connected to post 126. The outer portion of the arm is supported by a brace 132 which is rigidly affixed to the arm and has a plurality of openings 133 for receiving a pin 134 mounted on beam 104 to adjust the seat to different angles.

A leg extension bar 136 is pivotally mounted to beam 104 at the outer end of the bench. The lower end of this bar is connected to cables 137 which are trained about pulleys 138, 139 and connected to snap rings 66 at the free ends of cables 49. A first pair of foam rollers 143 is mounted on a cross-bar toward the lower end of the leg extension bar, and a second pair of rollers 144 is mounted on a cross-bar affixed to the arm 131 on which the bench seat is mounted. The upper set of rollers can thus be set at different heights by adjusting the position of arm 131.

The machine can be utilized for performing a wide variety of exercises. For standing exercises, the bench is removed, and the exerciser stands on the floor between the two weight stack. The carriages can be individually adjusted to position the free ends of the cables at the desired height, and the desired weight can be coupled to each of the cables. Handles or other gripping devices are attached to the free ends of the cables, and with the pulley blocks free to pivot about both axes, the pulleys will follow the cables regardless of the direction in which they are pulled. If desired for certain exercises, the carriages can be locked in a desired position, rather than being free to pivot about the vertical axes.

For exercises using the bench, the bench is moved into position, with the foot of the bench resting on the cross member of the frame, and the backrest and seat are adjusted to the desired positions.

For leg extensions, a person sits on the bench seat, facing away from the machine, with his legs over the upper rollers and behind the lower rollers. For leg curls, he stands facing the machine and to one side of it, with the front of the leg closest to the machine against the upper roller and the back of the leg against the lower roller.

The machine can also be used for non-weight lifting exercises such as chin-up and dips. For chin-ups, the bench is removed, and the exerciser uses the bars at the top of the machine. For dips, he swings the dip bars to their horizontal position and lowers himself on them.

For storage, the dip bars are raised, the backrest and the seat are both set to their lowest positions, and the bench is folded up into the corner with the foot still in position on the cross member. The stabilizing legs are folded up to their upright positions and secured there with the lock pins. With the legs raised, the latches engage the weight stack rods to hold them down, and the lock pins also engage the rods to keep the weights from being lifted. The machine thus folds up quite compactly when not in use and can be stored in a corner without taking up much floor space.

Figure 13:
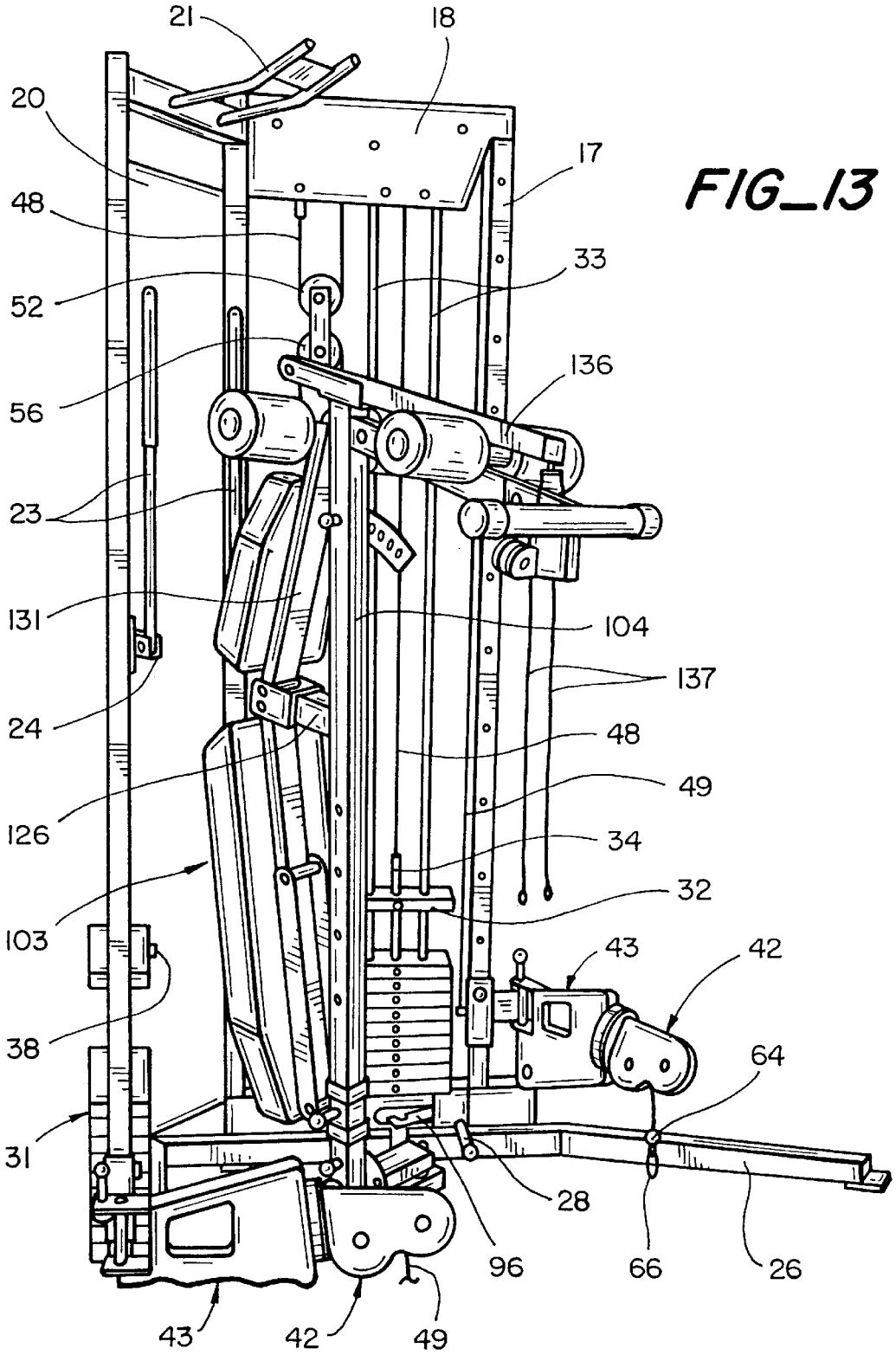
FIG. 13 is an isometric view of the embodiment of FIG. 1, showing the bench folded up for storage.

FIG. 13 shows the bench in its folded or storage position. In this particular figure, the upper plate 32 and the operating rod in each of the weight stacks is shown in a raised position in order to expose the opening 36 in the operating rods. With the rods raised in this manner, the cables are slack, and the free ends of cables 49 are dangling from pulley blocks 42 instead of being tensioned like they normally are.

It is apparent from the foregoing that a new and improved exercise machine has been provided. While only certain presently preferred embodiments have been described in detail, as will be apparent to those familiar with the art, certain changes and modifications can be made without departing from the scope of the invention as defined by the following claims.

What is claimed is:

1. In an exercise machine: a frame having a pair of upstanding sections disposed substantially at right angles to each other, a weight stack mounted on each of the frame sections, a cable coupled to each of the weight stacks for transferring, a pull on the cable to the weights in the stack, a pulley block through which the cable is withdrawn, a leg connected to each of the frame sections for movement between a supporting position and a storage position, interlock means engagable between the legs and respective ones of the weight stacks for preventing the weights from being raised when the legs are in the storage position, a bench which is removably connected to the frame and can be folded up between the two frame sections for storage, a carriage mounted on each of the frame sections and adapted to be positioned at different heights, and means mounting one of the pulley blocks on each of the carriages such that each of the pulley blocks is free to pivot about two axes of rotation so that the pulley block can follow the cable and remain aligned with the cable regardless of the direction in which the cable is pulled.

2. The exercise machine of claim 1 wherein one of the axes of rotation is substantially vertical, and the other is substantially horizontal.

3. The exercise machine of claim 2 further including means for selectively locking the pulley block in different rotational positions about the substantially vertical axis.

4. The exercise machine of claim 1 wherein each of the weight stacks includes a stack of weight plates, a vertically extending rod, and means for selectively connecting the plates to the rod, and the interlock means includes a latch which engages the rod and prevents it from being raised.

5. The exercise machine of claim 1 wherein the bench includes a backrest which is adjustable between horizontal, declined and inclined positions.

6. The exercise machine of claim 1 wherein the bench includes a backrest and a seat, each of which can be adjusted to different angles of inclination.

7. In an exercise machine: an upstanding frame, a pair of cables adapted to be pulled by an exerciser, means carried by the frame for independently resisting the pull on each of the cables, a pair of carriages mounted on the frame and adapted to be adjusted to different heights, and pulley blocks from which the cables are pulled mounted on the carriages, each of the pulley blocks being free to pivot about two axes of rotation so that the pulley blocks can follow the cables and remain aligned with the cables regardless of the directions in which the cables are pulled.

8. The exercise machine of claim 7 wherein each of the pulley blocks has a pair of side plates and a pair of pulleys mounted side-by-side between the side plates, with the cable entering the block at an end adjacent to one of the pulleys, being trained about the one pulley for an arc length of about 90 degrees, and exiting from the block between the two pulleys, the block being pivotally mounted to the carriage at the end where the cable enters.

9. The exercise machine of claim 7 wherein each of the carriages includes a slide which is mounted on a vertically extending frame member for movement to different vertical positions, a body pivotally connected to the slide for rotation about a substantially vertical axis, and means mounting the pulley block on the body for rotation about a substantially horizontal axis.

10. In an exercise machine:

an upstanding frame having a pair of vertically extending frame members;

a pair of cables adapted to be pulled by an exerciser;

means carried by the frame for independently resisting the pull on each of the cables;

a pair of carriages mounted on the frame and adapted to be adjusted to different heights, each of the carriages including a slide which is mounted on one of the vertically extending frame members for movement to different vertical positions, a body pivotally connected to the slide for rotation about a substantially vertical axis; and pulley blocks from which the cables are pulled mounted on the carriages by shafts which project from the pulley blocks and pass freely through openings in base plates on the bodies, bearings disposed about the shafts between the pulley blocks and the base plates, and means engaged with the shafts on the sides of the base plates opposite the pulley blocks for retaining the pulley blocks on the carriages, the pulley blocks being free to pivot about two axes of rotation so that the pulley blocks can follow the cables and remain aligned with the cables regardless of the directions in which the cables are pulled.

11. The exercise machine of claim 10 wherein the means for retaining the pulley block on the carriage comprises nut threadedly mounted on the shafts.

12. The exercise machine of claim 10 wherein the shafts are hollow, and the cables pass through the shafts.

13. The exercise machine of claim 9 further including means engagable between the body of the carriage and the slide for selectively locking the body in different rotational positions about the substantially vertical axis.

14. In an exercise machine: an upstanding frame, a pair of cables adapted to be pulled by an exerciser, means carried by the frame for independently resisting the pull on each of the cables, a pair of carriages mounted on the frame and adapted to be adjusted to different heights and moved to different rotational positions about a substantially vertical axis, means for selectively locking the carriages in the different rotational positions, and pulley blocks from which the cables are pulled mounted on the carriages and being free to pivot about a substantially horizontal axis so that the pulley blocks can track the directions in which the cables are pulled and remain aligned with the cables.

15. The exercise machine of claim 14 further including means for selectively locking the carriages in the different rotational positions.

16. The exercise machine of claim 14 wherein each of the carriages includes a slide which can be positioned at different heights along a vertically extending frame member, a body pivotally connected to the slide for rotation about the substantially vertical axis, and means mounting the pulley block on the body for rotation about the substantially horizontal axis.

17. In an exercise machine: an upstanding frame, a pair of cables adapted to be pulled by an exerciser, means carried by the frame for resisting the pulling of the cables, a bench having a horizontally extending foot removably mounted to the frame with the foot of the bench resting on a horizontally extending frame member, and a pair of pins which project downwardly from the foot and are received in sockets in the frame member for retaining the foot in a predetermined position on the frame member.

18. The exercise machine of claim 17 wherein means retaining the foot in the predetermined position comprises a pair of upwardly facing sockets in the frame member and a pair of pins which project downwardly from the foot and are received in the sockets.

19. The exercise machine of claim 17 wherein the bench is pivotally mounted on the foot for movement between a generally horizontal position for use and a generally vertical position for storage.

20. The exercise machine of claim 17 wherein the bench has an inclined beam with an inner end pivotally connected to the foot and an outer end supported by an upstanding leg, a seat pivotally mounted on the beam for adjustment to different angles, and a back rest pivotally mounted on the beam for adjustment to different angles.

21. The exercise machine of claim 17 further including a leg exercise bar pivotally connected to one end of the bench, means connecting the bar to the cables so that movement of the bar exerts a pull on the cables, a lower roller affixed to the bar for engagement by a lower portion of an exerciser's leg, and an upper roller mounted on the bench for engagement by an upper portion of the exerciser's leg.

22. The exercise machine of claim 21 wherein the upper roller is mounted on the bench in a manner permitting the height of the roller to be adjusted.

23. The exercise machine of claim 17 wherein the frame has two sections which are disposed substantially at right angles to each other, and the frame member on which the foot of the bench rests extends diagonally between the two sections.

24. In an exercise machine: an upstanding frame, a weight stack mounted on the frame, a cable coupled to the weight stack for transferring a pull on the cable to the weights in the stack, a leg connected to the frame for movement between a generally horizontal supporting position and a generally vertical storage position, and interlock means engagable between the leg and the weight stack for preventing weights from being raised unless the leg is in the supporting position.

25. The exercise machine of claim 24 wherein the weight stack includes a stack of weight plates, a vertically extending rod, and means for selectively connecting the plates to the rod, and the interlock means includes a latch which engages the rod and prevents it from being raised.

26. The exercise machine of claim 25 wherein the rod has a knob at its lower end, the latch is pivotally mounted to the frame for movement between locking and released positions, the latch having a notch for receiving the rod adjacent to the knob when the latch is in the locking position.

27. The exercise machine of claim 26 wherein the latch is moved from the locking position to the released position by insertion of a pin which secures the leg in its supporting position.

28. The exercise machine of claim 25 further including a pin for securing the leg in its supporting and storage positions, the pin being inserted through openings in the leg and in the weight stack rod to secure the leg in the storage position and prevent the weights from being raised.

29. In an exercise machine: an upstanding frame, a cable adapted to be pulled by an exerciser, means carried by the frame for resisting the pull on the cable, a leg connected to the frame for movement between a generally horizontal supporting position and a generally vertical storage position, and interlock means for preventing the cable from being pulled unless the leg is in the supporting position.

* * * * *